US005345706A

United States Patent [19]

Brown

[11] Patent Number: 5,345,706

[45] Date of Patent: Sep. 13, 1994

[54] FIREARM SUPPORT

[75] Inventor: Michael G. Brown, The Woodlands, Tex.

[73] Assignee: Huntech, Inc., Houston, Tex.

[21] Appl. No.: 82,981

[22] Filed: Jun. 25, 1993

[51] Int. Cl.[5] ..... F41A 23/06

[52] U.S. Cl. ..... 42/94

[58] Field of Search ..... 42/94, 90; 89/37.04; 124/29

[56] References Cited

U.S. PATENT DOCUMENTS

| | | | |
|---|---|---|---|
| 879,052 | 2/1908 | Jeranek | 42/94 |
| 1,890,423 | 12/1932 | Teagarden | 42/94 |
| 3,327,422 | 6/1967 | Harris | 42/94 |
| 4,345,398 | 8/1982 | Pickett | 42/94 |
| 4,393,614 | 7/1983 | Pickett | 42/94 |
| 4,575,964 | 3/1986 | Griffin | 42/94 |
| 4,676,021 | 6/1987 | Groba | 42/94 |
| 5,194,678 | 3/1993 | Kramer | 42/94 |

*Primary Examiner*—Stephen C. Bentley

*Attorney, Agent, or Firm*—Browning, Bushman, Anderson & Brookhart

[57] ABSTRACT

A firearm support is provided with a receiving and attachment means for receiving the firearm and securely holding it. The attachment means engages with the sling mount bolt of a firearm and draws the firearm and firearm support tightly but releasably together. The attachment means includes gripping arms with pins that engage a sling bore in the sling mount bolt. The attachment means also includes a fixed body or neck with an inner bore that receives the sling mount bolt and gripping arms. The inner bore has an elongate camming surface to engage an outer surface on the gripping arms for urging the pins into the sling bore and holding them in place as the gripping arms and sling mount bolt are pulled into the inner bore. The firearm support includes a telescoping leg that has an internal lock to maintain the leg in a closed or carrying position with respect to the firearm. Adjustment means are provided to position the telescoping leg substantially parallel to the barrel of the firearm when in the folded carrying position.

12 Claims, 6 Drawing Sheets

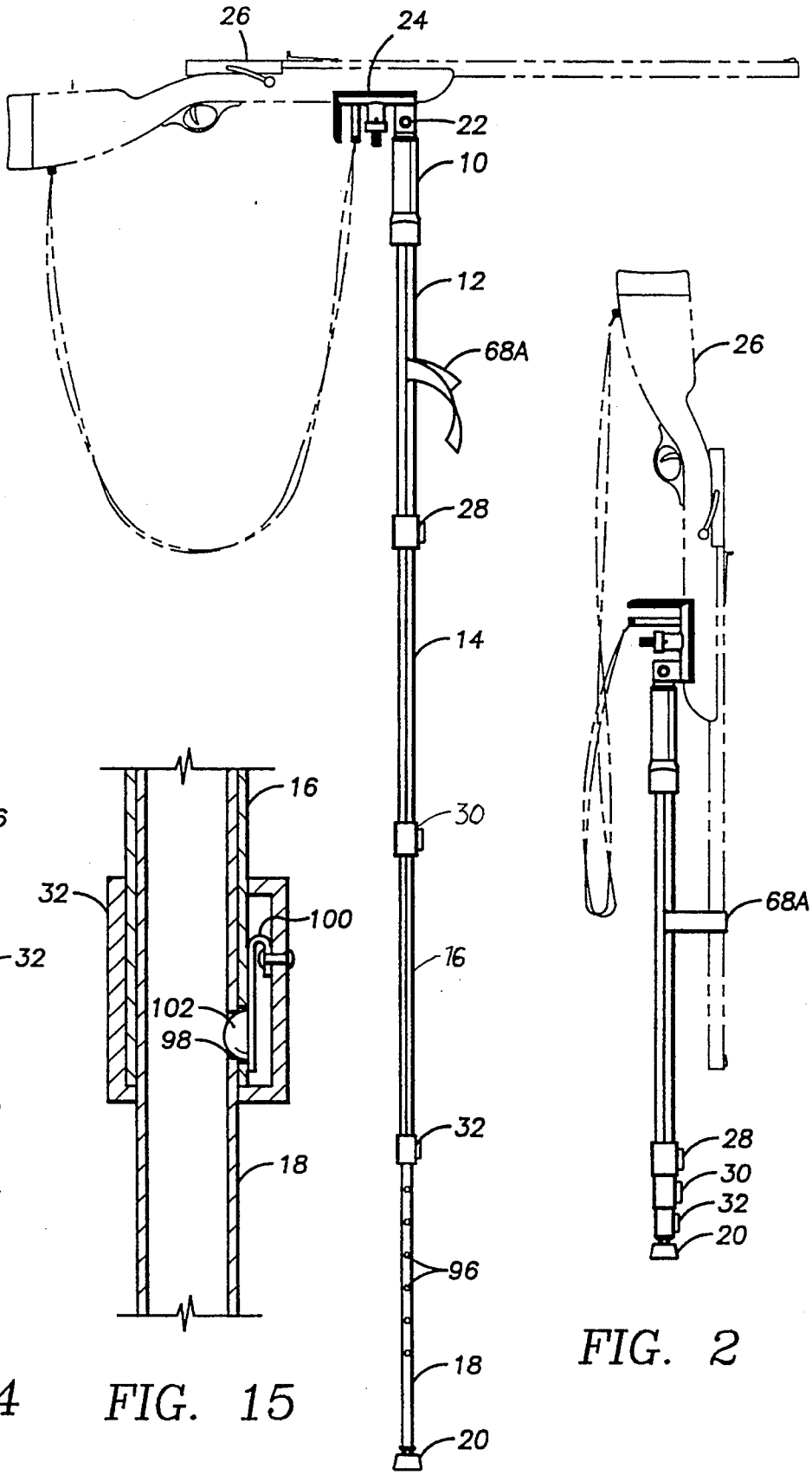
FIG. 1
FIG. 2
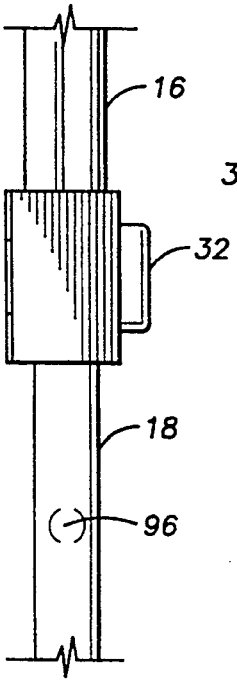
FIG. 14
FIG. 15

FIG. 3
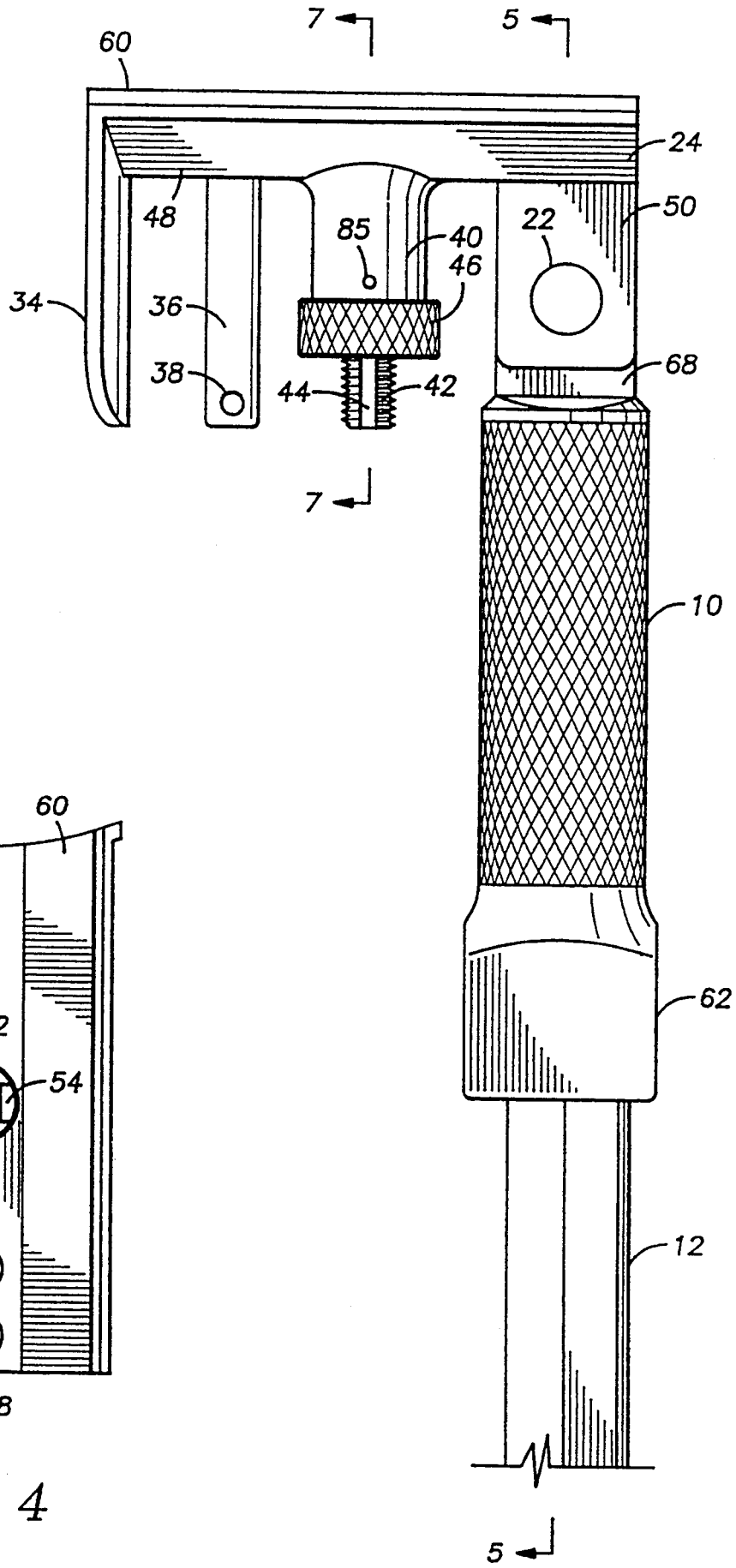
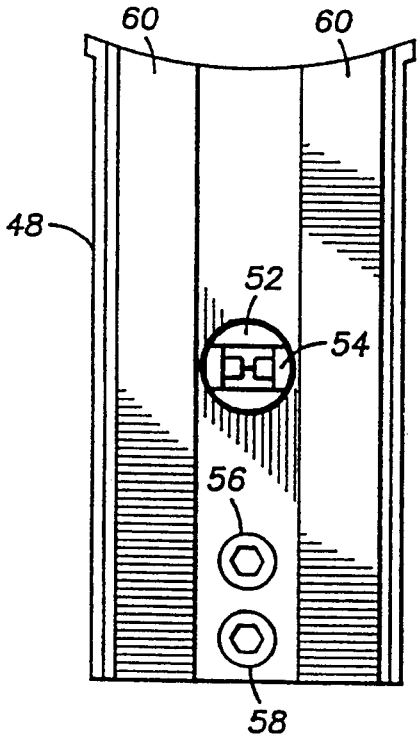
FIG. 4

FIG. 10
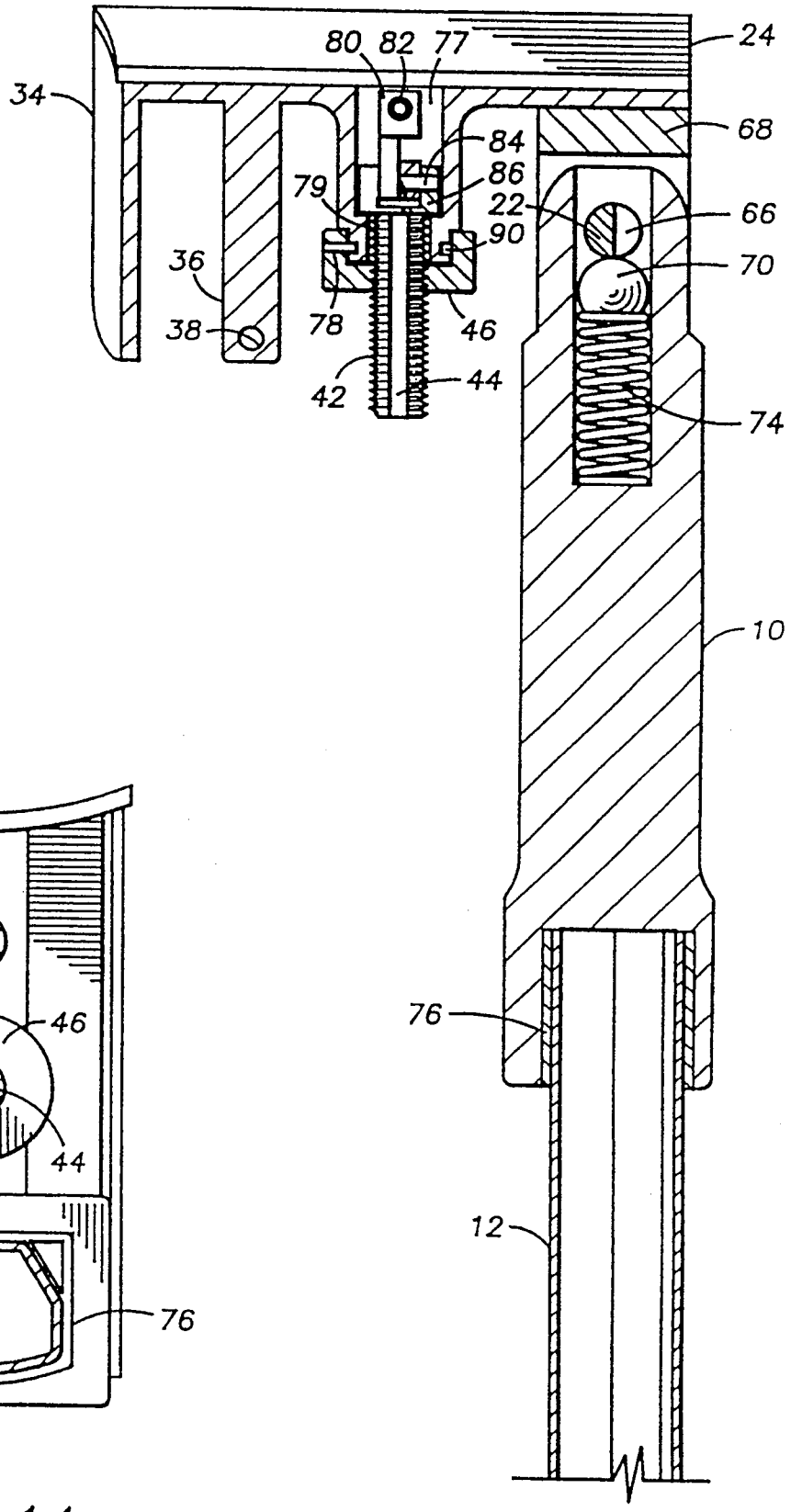
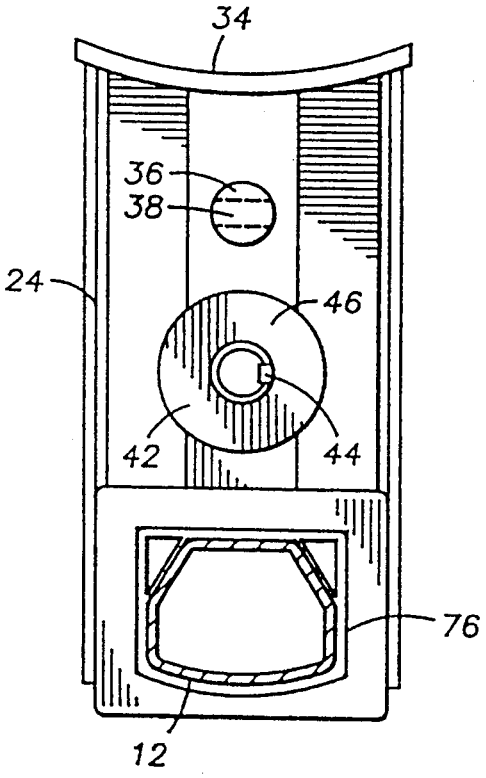
FIG. 11

FIREARM SUPPORT

BACKGROUND OF THE INVENTION

1. Field of the Invention

The present invention relates to firearm supports, and more particularly, to a folding firearm support configuration with improved rifle attachment mechanism and self-locking in a folded carrying position.

2. Description of the Prior Art

Rifle or firearm supports of varying description and design have been in existence since the advent of firearms. This is because firearm supports can often dramatically improve firing accuracy and consistency for novices as well as experts. Thus, significant motivation exists for the development and use of firearm supports. The following U.S. Patents provide examples of rifle supports that were utilized in the past.

U.S. Pat. No. 4,393,614 describes a monopod rifle rest having a base tube with a plurality of smaller diameter concentric tubes with a barrel clamp.

U.S. Pat. Nos. 879,052 and 1,890,423 describe a monopod rifle rest with a telescopically extending tubular member attached to a U-shaped member upon which a gun or rifle is rested.

U.S. Pat. No. 4,575,964 describes a rifle rest having two U-shaped members, one at each end of a telescoping support, for support of a rifle at one end and for support of the rifle rest on another object such as a knee. A carrying strap is attached to the telescoping support.

U.S. Pat. No. 4,676,021 describes a portable firearm support comprising two telescoping tubes with a firearm receiving means at the upper end and a latch means to engage and release the two tubes in an extended position.

U.S. Pat. No. 4,345,398 describes a rifle rest with a monopod pivotally mounted to a mount plate. The mount plate is then clamped to the barrel of a gun or rifle. U.S. Pat. No. 3,327,422 discloses a rifle rest with a seat and a link system supported by the seat for attachment to the rifle sling mounting bolt.

When using a rifle for hunting purposes, it is often necessary to carry the rifle and the firearm support for significant distances and in rough terrain. While the rifle supports disclosed hereinbefore perform the intended function of supporting the rifle while shooting, they may be awkward or heavy to carry.

Some devices are difficult to mount to the rifle and may require special tools for this purpose, making their use potentially difficult and time-consuming. Furthermore, the folding rifle supports disclosed in previous U.S. patents may make firing difficult when it is desired to fire the rifle with the support in the folded-up carrying position, as may be necessary in some situations.

Consequently, there remains a need for an improved lightweight rifle support that offers greater ease of use in the various circumstances in which they may be utilized. Those skilled in the art will greatly appreciate the advantages of the present invention, which significantly alleviates the problems of previous firearm supports while still providing the important advantage of a very steady rifle.

SUMMARY OF THE INVENTION

Therefore, an object of the present invention is to provide an improved lightweight firearm support.

Another object of the present invention is an improved attachment means for readily connecting the firearm support to a rifle without the need for tools.

Yet another object of the present invention is to provide an improved folding mechanism that provides an unobtrusive firearm support that is self-locking in the folded or carrying position.

The present invention is directed to a firearm support having a base defining a support surface and from which at least one support leg extends for rigid engagement with a relatively stable member such as the ground to allow a steady support of the firearm. A body with a bore therethrough extends from the base. A first gripping arm is provided for engaging the sling post of the firearm. Pulling means are carried by the body and extend through the bore in the body for pulling the gripping arm and sling post into the bore to thereby urge the firearm into engagement with the support surface.

Other features and intended advantages of the invention will be more readily apparent by reference to the following detailed description in connection with the accompanying drawings.

BRIEF DESCRIPTION OF THE DRAWINGS

FIG. 1 is a elevational view of a firearm support in accord with the present invention extended for use;

FIG. 2 is a elevational view of the firearm support of FIG. 1 collapsed for transport;

FIG. 3 is a partial side elevational view of the firearm support of FIG. 1; FIG. 4 is a plan view of the firearm of FIG. 3;

FIG. 10 is a partial side elevational view of the firearm support of FIG. 8 along lines 10—10; FIG. 11 is a partial cross-sectional view of the firearm support of FIG. 8 along lines 11—11;

FIG. 14 is a partial elevational view of two adjoining telescoping leg sections;

FIG. 15 is a cross-sectional view of the leg section of FIG. 14 rotated 90°;

Figure 5:
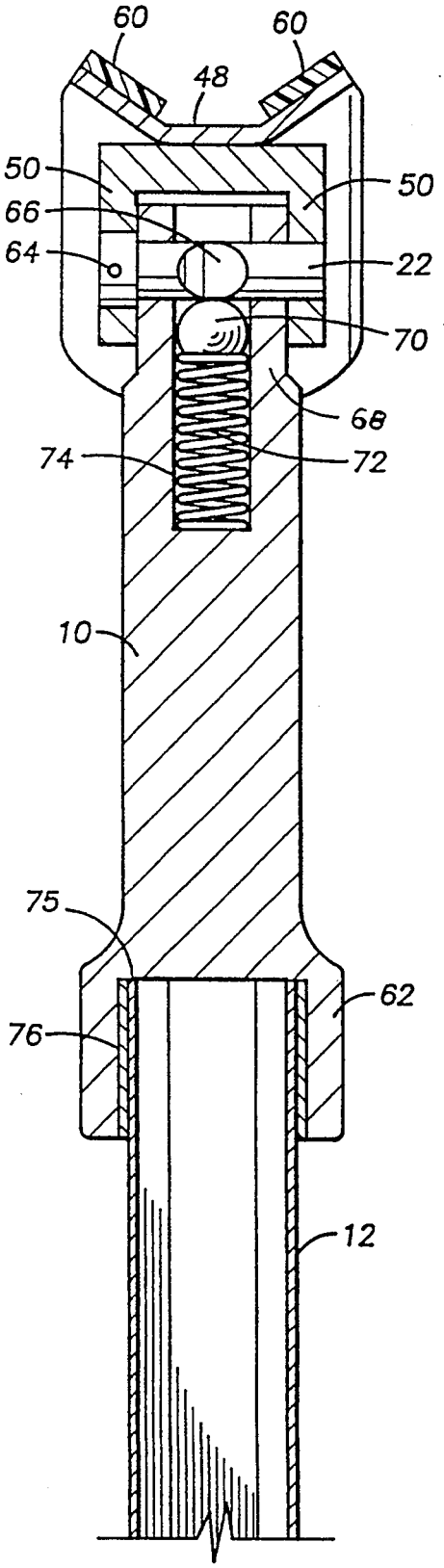
FIG. 5 is a cross-sectional view of the firearm support of FIG. 3 along lines 5—5.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DESCRIPTION OF THE PREFERRED EMBODIMENTS

Referring to the drawings, and more particularly to FIG. 1, there is shown a firearm support in accord with the present invention. The firearm support is shown in the open or operational position. It is to be noted that the firearm support of the present invention will be described in relation to rifle 26, which normally includes a sling post having a sling post bore for connecting a rifle sling. It is to be further noted that while the present invention is described in relative terms such as upper, lower, and forward, such descriptions are for convenience only in understanding the preferred embodiments of the present invention and are not to be construed as limiting the invention in any manner. Generally such descriptions assume the firearm support is mounted to the rifle and describe their position with respect to the user of the device.

The present invention is comprised of a cradle assembly 24 that holds and attaches to the rifle 26. The cradle assembly 24 is attached to the hand grip 10 by a hinge pin 22 that allows pivoting or folding of the cradle assembly 24 with respect to hand grip 10. Attached to the hand grip 10 is a plurality of concentric tubular telescoping leg members 12, 14, 16 and 18, collectively designated the "leg," that preferably form a single leg, or monopod, firearm support. The mechanisms of the present invention could be used with a multi-leg support such as a tripod. However, especially for convenience in carrying the support over distances, the present invention preferably uses a single leg. The upper leg member 12 is attached directly to the hand grip 10 at one end, while at the other end of upper leg member 12 is a latch 28 that allows the leg extension to be locked at different length positions. The leg extension 14 has a latch 30 at the distal end that allows the leg extension 16 to be locked at different length positions. The distal end of the leg extension 16 comprises a latch 32 that allows the lower leg member 18 to be locked at different length positions. The lower leg member 18 may have a plurality of knock outs 96 down the length of the leg as shown in FIG. 1 and FIG. 15. Foot 20 is connected as a ball and socket (not shown) at the distal end of the lower leg member 18. Foot 20 may also be connected with a threaded bolt so that it may be either fixed when the bolt is tightened or rotatable when the bolt is loosened. While foot 20 is preferably engageable with the ground, foot 20 could be modified to engage with other items that are sufficiently stable to provide a steady rest for the rifle.

FIG. 2 shows the rifle support in the closed position when attached to the rifle 26. The telescoping leg members are collapsed such that the latches 28, 30, 32 and the foot 20 butt up against one another. Although the telescoping leg is releasably locked in the folded carrying position in a manner discussed hereinafter, the leg may additionally be secured by VELCRO straps 68A that are attached to section 12 by means such as an adhesive. This configuration is used to transport the rifle with the support attached. Because of the attachment assembly and its manner of cooperative interaction with the sling post on the firearm (as discussed hereinafter), the support is securely attached to the firearm, yet easily and quickly removable.

FIG. 3 shows a partial side elevational view of the present firearm support. Three main sections of the firearm support shown in FIG. 3 are the cradle assembly 24, the hand grip 10, and the upper leg member 12. It is to be noted that hand grip 10 and upper leg member 12 may be manufactured so that the only upper leg 12 is visible with no particular markings to differentiate hand grip 10. Furthermore, hand grip 10 may be reduced in length so that it effectively no longer functions as a hand grip but merely operates as a connector portion of upper leg 12 and houses the folding mechanism shown in FIG. 5 as discussed hereinafter.

The cradle assembly 24 comprises a base 48 that mates to rifle 26. On top of the base 48, a pad 60 is placed to provide a surface for resting the rifle. The pad 60 is preferably constructed from a soft covering such as a polyethylene or any other strong durable plastic or resilient material to prevent noise between the cradle assembly 24 and the rifle 26 and to protect the rifle from scratches. The guard 34 is formed onto a forward end of the cradle assembly 24. Because the present interconnection utilizes the rifle sling mount, an additional sling mount 36 having a hole 38 extends downwardly from the cradle assembly 24. Thus, the user will be able to carry the rifle with a rifle sling in a normal manner even when the present invention is secured to the rifle.

Located near the center of the cradle assembly 24 is a fixedly mounted neck 40 that supports rotatable, internally threaded knob 46 for adjusting the position of the threaded member 42 along its axis, as discussed in greater detail hereinafter. While neck 40 is preferably a cylindrical tube, other tubular shapes could be used. For instance, a portion of neck 40 could have a square or rectangular cross-section. The threaded member 42 has a key way 44 along its axis. Rotation of the knob 46 moves the threaded member 42 rectilinearly in bore 77 (See FIG. 10), moving the attachment assembly 54 into and out of opening 52.

At one end of the cradle assembly 24, bracket 50 is connected to the hand grip 10 by a hinge pin 22. At the lower end of the hand grip 10, a base 62 connects to the upper leg member 12. FIG. 4 shows a plan view of the present monopod firearm support of FIG. 3. Two allen bolts 56 and 58 fasten the base 48 to the bracket 50. The attachment assembly 54 provides the means for attaching the firearm support to the firearm through opening 52 in base 48.

FIG. 5 shows a cross-sectional view of the present firearm support along line 5—5 of FIG. 3 with the leg in an unlocked (unfolded) or operational position with respect to cradle 24, as the monopod would be in use for firing the firearm. Pin 22 is affixed to the bracket 50 by pin 64 so as to prevent rotation of pin 22. As the leg is rotated for folding to the carrying position, the depression 66 on pin 22 is brought into alignment with ball 70 (FIG. 2). The folded up carry position is used during transport or stalking, for example. The ball 70 is biased into the depression 66 by way of a spring 72 that resides in the bore 74 in extension 68 of hand grip 10. The insertion of the ball 70 into the depression 22 locks the bracket 50 into the carry position.

The upper leg member 12 is seated in recess 75 of base 62 and held in place by annular shim 76, thus attaching the leg to the cradle assembly. The hand grip can also be molded in one piece with the upper leg section. Thus, the distinctive hand grip portion 10 is optional.

Figure 6:
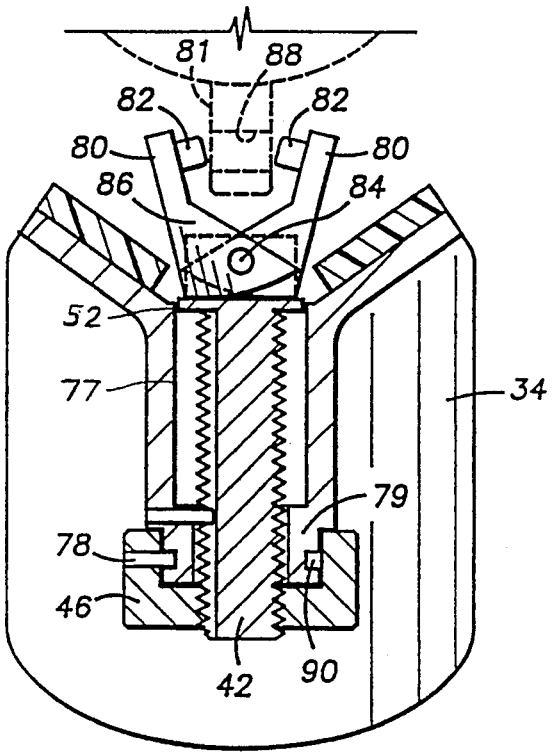
FIG. 6 is a cross-sectional view of a firearm support rifle attachment means along lines 7—7 of FIG. 3 with the attachment means extended.
Figure 7:
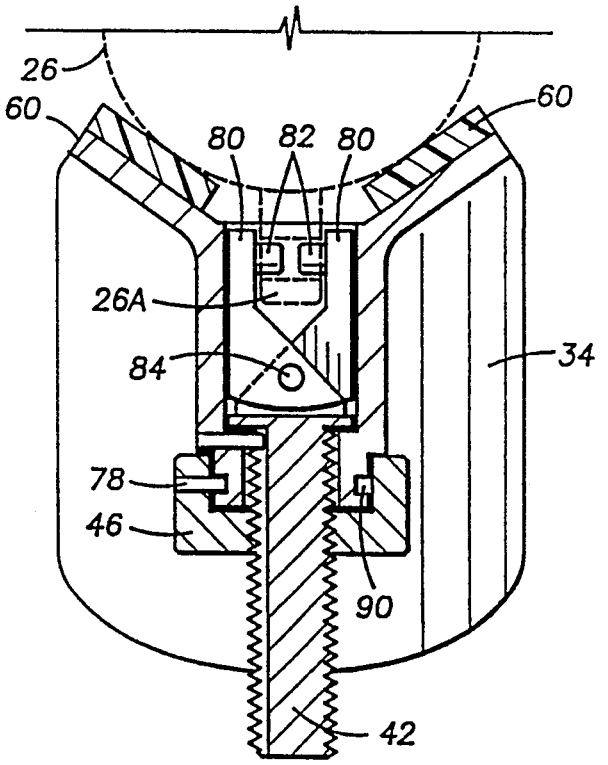
FIG. 7 is the view of FIG. 6 with the attachment means in the retracted position.

FIG. 7 illustrates a cross-section of the present firearm support along lines 7—7 of FIG. 3. In FIG. 6, the attachment assembly 54 is shown in an extended position for engaging or releasing the present invention from the rifle. FIG. 7 is a similar view and shows the attachment assembly in the retracted position in which the present invention is secured to the rifle. The attachment arms 80 are hinge-connected at one end by a pin 84 to a head 86. At the respective distal ends, each attachment arm has an attachment stud 82. The studs 82 are cooperatively aligned with each other whereby they face each other when the attachment assembly is in a closed position. The opening 52 and bore 77 are sized to force the arms 80 together so that studs 82 grasp rifle sling post 88. Similarly, the opening 52, bore 77, head 86, arms 80 and studs 82 are all sized such that when the arms 80 are cammed to a closed position by the wall of opening 52 and the wall defining bore 77, the space between them will accommodate the sling post 81 while the studs 82 engage bore 88 in the sling post. The space between the arms 80 and length of the studs 82 can be selected to accommodate significant size variations in the diameter of the sling post 81. The relative length of the sling post 81 is effectively inconsequential due to the retracting operation of the engagement means, which can accommodate practically any reasonable length of the sling post. In operation, the rifle sling is removed from sling post and 81 prior to engagement with attachment assembly 54. The rifle sling may be reattached to sling post 36 on the firearm support base 48 as desired.

Figure 16:
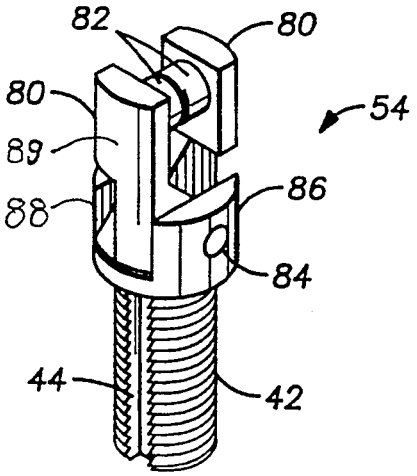
FIG. 16 is an isometric view of firearm attachment assembly.

In FIG. 16, further detail shows that the attachment arms 80 reside in slot 88 in the head 86. Each arm 80 pivots around pin 84. Each arm 80 has a cam surface 89 that engages the wall defining bore 77 to urge studs 82 inwardly for engagement with bore 88 of sling post 81 as head 86 moves downwardly in bore 77. Once inside bore 77, arms 80 are locked into engagement with sling post 81. Further downward movement of head 86 does not continue to further urge arms 80 inwardly because bore 77 is preferably straight and its walls have a substantially constant thickness.

Figure 13:
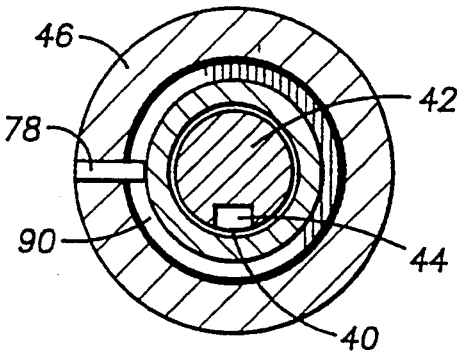
FIG. 13 is a cross-sectional view along lines 13—13 of FIG. 12.

The head 86 is connected to threaded member 42 for longitudinal movement within bore 77 of neck 40. The threaded member 42 is threadably engaged with rotatable knob 46. Rotatable knob 46 is rotatably secured to neck 40 by guide pin 78. The pin 78 extends into annular grove 90 located in a narrowed portion 79 of neck 40 and retains the knob 46 in place about narrowed portion 79 while still allowing rotational movement (see also FIG. 13). A pin 85 (see FIG. 3) mounted through neck 40 extends into bore 77 and engages keyway 44, thereby preventing member 42 from rotating with knob 46. Thus, counter-clockwise rotation of the rotatable knob 46 extends the threaded member 42 and attachment arms 80 through opening 52, as shown in FIG. 6. Thus, the present invention may be attached to, or detached from, rifle 26 without tools.

In the extended configuration, the studs 82 can be aligned to engage bore 88 the rifle sling post 81 (shown in dotted lines). The arms effectively form an adjustable yoke of varying width that can be connected to rifle sling posts that may vary somewhat in width. Turning the rotatable knob 46 in a clockwise direction retracts the threaded member 42 and attachment arms 80 into opening 52 and bore 77, thereby bringing studs 82 toward each other as shown in FIG. 7. Studs 82 are urged into locking engagement within bore 88 by camming engagement between camming surfaces 89 and the wall defining bore 77. As the rotation is continued, the undercarriage of the rifle is drawn down against pads 60 thereby creating a snug fit between the rifle and the present support.

Figure 17:
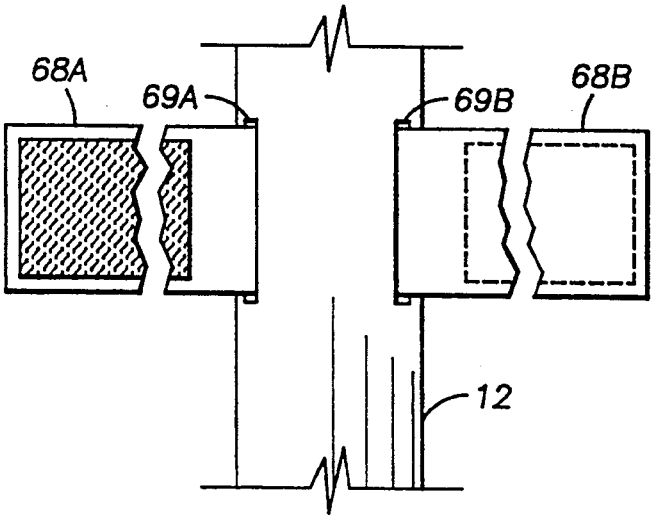
FIG. 17 is an elevational view of a VELCRO belt for securing the rifle bore with the telescoping support.

FIG. 17 discloses an additional VELCRO latch 68 with ends 68A and 68B. Ends 68A and 68B may be wrapped around the rifle barrel to hold the firearm support in the carrying or folded position even when significant jarring occurs. Such significant jarring may occur when firing a large bore rifle with the firearm support in the closed or carrying position. Latch 68 may extend through slots 69A and 69B in leg member 12. Latch 68 may also tie around or be glued or fastened to leg member 12 in some manner.

Figure 8:
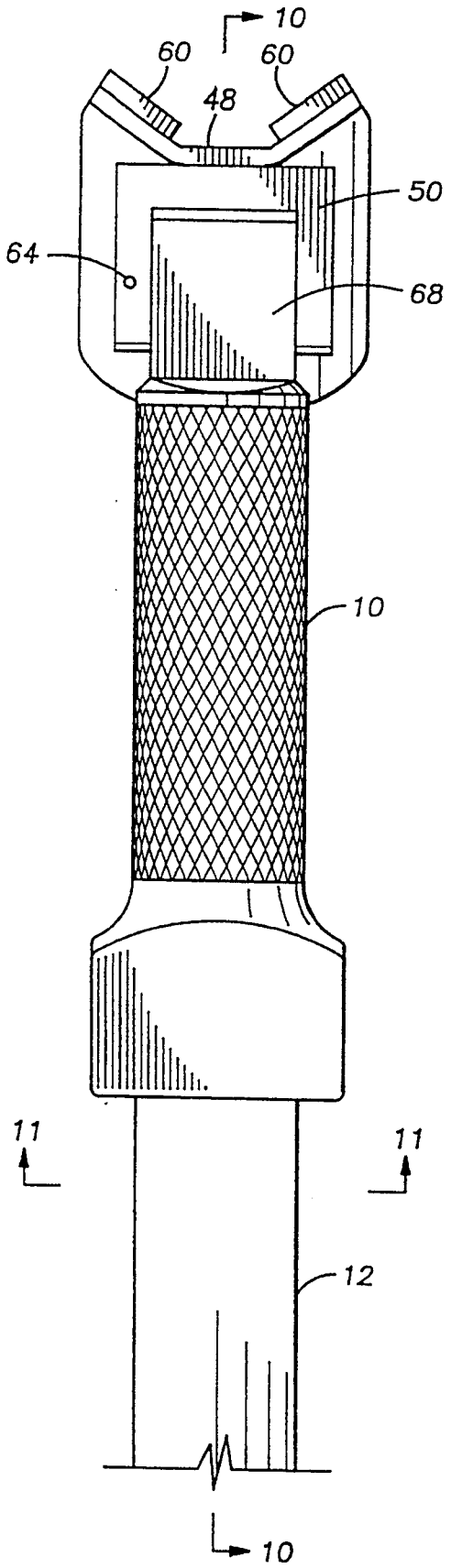
FIG. 8 is a partial front elevational view of a firearm support in an extended position.
Figure 9:
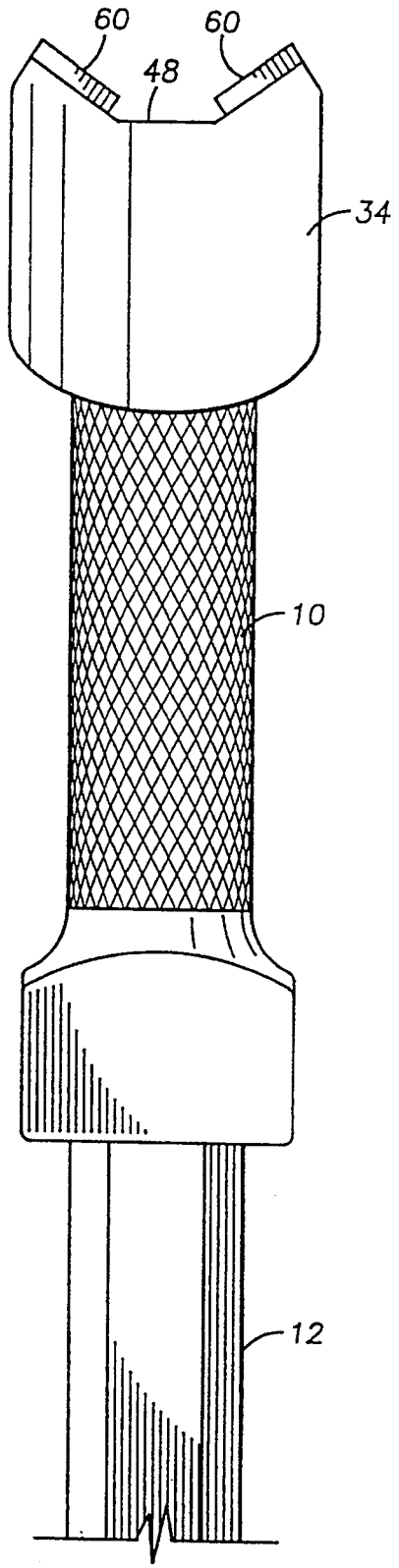
FIG. 9 is a partial back elevational view of a firearm support extended for use.

FIGS. 8 and 9 show partial front and back elevational views of the present monopod firearm support in an unlocked (open) position. In FIG. 9 the back of the base 48 is connected to a guard 34. FIG. 10 shows a partial side elevational view of the present firearm support along lines 10—10 of FIG. 8. As discussed with respect to FIG. 5, when the hand grip 10 is in the unlocked position, bail 70 is prevented from being inserted into the depression 66 in the pin 22. While ball 70 is not in depression 66, cradle 24 and attached rifle 26 is pivoted easily for aiming.

Figure 12:
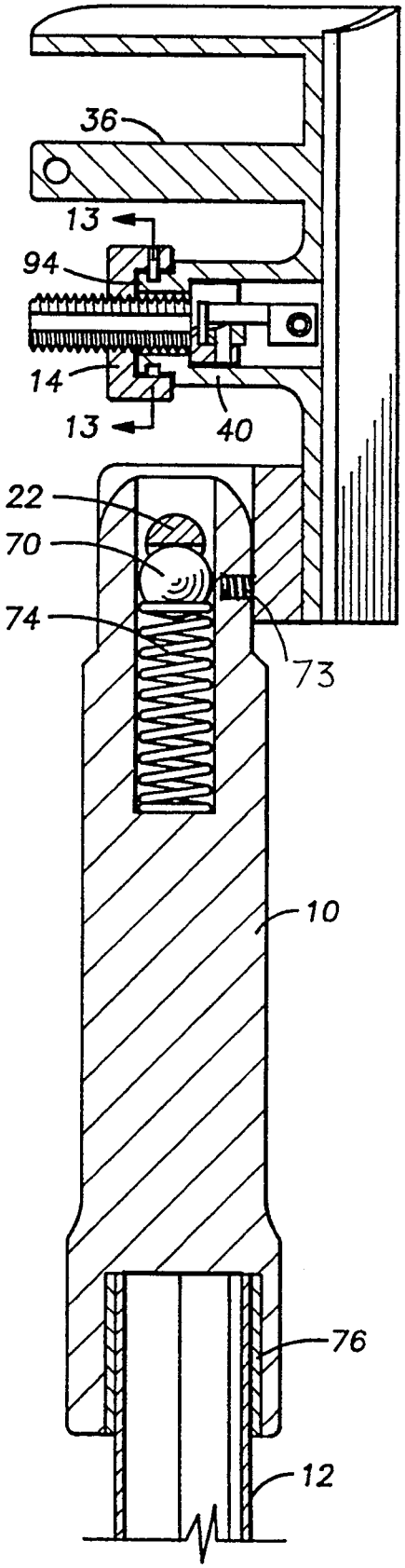
FIG. 12 is a partial side elevational cross-sectional view with cradle assembly rotated 90° from FIG. 10.

FIG. 12 shows the monopod firearm support in the folded (locked) position. When the leg is collapsed and raised in the closed carrying position, it is desirable to lock the leg in that position. For this purpose, spring loaded bail 70 engages the depression 66 on the pivot pin 22. Allen screw 73 is used to adjust the relative position of the leg or monopod so that it is substantially parallel with respect to the rifle barrel and, more importantly, does not extend into the line of fire of rifle 26. A desired relative position between the rifle and monopod leg is seen in FIG. 2 with the leg substantially parallel to the rifle barrel.

FIG. 14 shows a partial elevational view of two adjoining leg sections of the present monopod firearm support. FIG. 15 shows a cross-sectional view of the leg sections of FIG. 14 rotated 90°. Clip spring 100 and bead 102 are mounted within latch 32. Bead 102 is biased by clip spring 100 toward leg extension 18. When a knock 96 is removed leaving an opening 98, the bead 102 will seat in the hole and lightly hold the extension leg at that position while the clasp 32 can be locked down. This arrangement allows for rapid extension of the leg to a preselected length without having to look at the monopod if this feature is desired.

The present device may be manufactured in combined components. For instance, the cradle, hand guard, sling mount, neck and bracket are preferably molded in one component. The hand grip and upper leg segment are also preferably molded in one component. Material for the support should be of lightweight, high impact plastic or metal or other lightweight material.

In operation, the firearm 26 is held in the cradle assembly 60 by the attachment means that engage with the sling mount of a firearm and draw the firearm and support tightly, but releasably, together. The rifle support can be carried in a folded, retracted configuration beneath the barrel of a gun or rifle and can be quickly and selectively extended to a preselected length to provide a secure rest for aiming the gun or rifle. A sling mount 36 is attached to the firearm support to provide easy transport of the rifle. The rifle support of this invention is lightweight and compact. When not in use, it is normally aligned with, and releasably locked beneath, the firearm barrel. The rifle may be fired with the firearm support in the carrying position because means are provided (item 73 in FIG. 12) for limiting movement of the monopod to prevent it coming within the line of fire. The firing support of the present invention is capable of quick and easy pivoting and extension to provide a functional rest of selected length with minimum effort.

In a preferred embodiment of the invention, the concentrically positioned, telescoping tubes and cylinders are provided with latches to effectively lock the tubes and cylinders in the extended configuration and to facilitate return to the retracted position when it is desired to restore the monopod to its non-functional, folded configuration.

The monopod is characterized by a plurality of concentrically mounted tubular members, cylinders, or legs provided in a biased, normally retracted relationship inside a base member, cylinder or leg. Latches are provided that allow locking or unlocking of the tubular members, cylinders or legs in an extended or collapsed position. The cradle assemble 24 is of particular interest and allows mounting to the rifle without use of specialized tools. It is adapted to clasp onto the sling post 81 provided on most rifles for mounting a sling. The sling post 81 includes a bore 88 in which the two studs 82 engage. When knob 46 is turned, threaded member 42 moves rectilinearly in the bore in the neck. The slotted head 86 can be extended out of the neck bore 77 or drawn into the neck bore 77. When the slotted head 86 is out of the bore 77 and into the cradle 24, the arms 80 and studs 82 are free to pivot open away from each other. The cradle 24 may then be positioned on the firearm to juxtapose the studs 82 and the bore 88 in the sling mount of the firearm. Turning the knob 46 draws the slotted head 86 into the neck bore 77 to thereby force the two arms 80 toward each other and bring the studs 82 into the bore 88 on the sling mount post 81. The bore 77 in the neck 40 is of a diameter that maintains the arms 80 together and the studs 82 engaged in the bore 88 on the sling mount, when the slotted head is withdrawn into said neck. Drawing the threaded member 42 into the 40 neck also draws the firearm undercarriage tightly into the cradle 26. Thus, the present invention allows ready and secure connection of the firearm support to the rifle without special tools.

The foregoing disclosure and description of the invention is illustrative and explanatory thereof, and it will appreciated by those skilled in the art that various changes in the size, shape and materials, as well as in the details of the illustrated construction or combinations of features, may be made without departing from the spirit of the invention.

What is claimed is:

1. A firearm support for a firearm having a sling post with a sling-mounting bore therethrough, said firearm support comprising:

a base defining a support surface for said firearm;

at least one support leg extending from said base;

a body extending from said base and having a bore therethrough;

a first gripping arm for grippingly engaging said sling post; and pulling means carried by said body and extending through said bore in said body for pulling said gripping arm and said sling post into said bore to thereby urge said firearm into engagement with said support surface.

2. The firearm support of claim 1, further comprising a second gripping arm being disposed for gripping engagement with said sling post on an opposite side of said firearm sling post with respect to said first gripping arm.

3. The firearm support of claim 2, wherein said pulling means includes a rod adapted for longitudinal movement in said bore, said rod having a head portion, said first gripping arm being affixed to said head portion and means for effecting movement of said rod in said bore.

4. The firearm support of claim 3, wherein said first and second gripping arms are pivotally secured to said head portion of said rod to define a yoke of varying width.

5. The firearm support of claim 3, wherein said rod is threaded and further includes adjustment nut means rotatably attached to said body and threadedly engaging said threaded rod, and means for preventing rotation of said threaded rod in response to rotation of said adjusting nut whereby rotation of said adjusting nut results in longitudinal movement of said threaded rod in said bore.

6. The firearm support of claim 3, wherein said bore defines a camming surface, said first and second arms being cammed toward one another by said camming surface in response to movement of said rod in said bore pulling said first and second arms into said bore.

7. The firearm support of claim 1, further comprising a pin on said first gripping arm, said pin being insertable into said sling-mounting bore of said sling post for grippingly engaging said sling post.

8. The firearm support of claim 1, wherein said support leg includes a connection portion, hinge means between said connection portion and said base for pivotable movement of said support leg with respect to said base between an open operational position and a closed carrying position, and releasable locking means internal to said connection portion for locking said support leg in said closed carrying position.

9. The firearm support of claim 8, further comprising support leg position adjustment means for adjusting the relative angle between said base and said support leg when said support leg is locked in said closed carrying position.

10. The firearm support of claim 8, wherein said locking means further comprises a locking member internally movable within said connection portion, said locking member being aligned for reception by a lock recess when said support leg is in said closed carrying position, and biasing means for urging said locking member into engagement with said lock recess.

11. The firearm support of claim 8, wherein said firearm support includes only a single support leg.

12. The firearm support of claim 8, wherein said support leg further comprises a plurality of support leg members telescopically interconnected together.

* * * * *